US011891676B2

(12) United States Patent
Köyer et al.

(10) Patent No.: US 11,891,676 B2
(45) Date of Patent: Feb. 6, 2024

(54) FLAT STEEL PRODUCT HAVING IMPROVED PROCESSING PROPERTIES

(71) Applicant: ThyssenKrupp Steel Europe AG, Duisburg (DE)

(72) Inventors: Maria Köyer, Dortmund (DE); Fred Jindra, Lennestadt (DE); Dirk Czupryna, Duisburg (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 0 days.

(21) Appl. No.: 17/978,246

(22) Filed: Nov. 1, 2022

(65) Prior Publication Data

US 2023/0136262 A1 May 4, 2023

(51) Int. Cl.

| | |
|---|---|
| ***C21D 9/46*** | (2006.01) |
| ***C21D 8/02*** | (2006.01) |
| ***C22C 38/04*** | (2006.01) |
| ***C22C 21/02*** | (2006.01) |
| ***C23C 2/12*** | (2006.01) |
| ***C23C 2/40*** | (2006.01) |
| ***B21D 22/02*** | (2006.01) |

(52) U.S. Cl.

CPC ..... *C21D 9/46* (2013.01); *B21D 22/022* (2013.01); *C21D 8/0226* (2013.01); *C21D 8/0236* (2013.01); *C21D 8/0273* (2013.01); *C22C 21/02* (2013.01); *C22C 38/04* (2013.01); *C23C 2/12* (2013.01); *C23C 2/40* (2013.01); *C21D 2211/008* (2013.01)

(58) Field of Classification Search

None

See application file for complete search history.

(56) References Cited

U.S. PATENT DOCUMENTS

| | | | |
|---|---|---|---|
| 2016/0215360 | A1 | 7/2016 | Köyer et al. |
| 2017/0026060 | A1 | 1/2017 | Thompson et al. |
| 2020/0216925 | A1 | 7/2020 | Banik et al. |

FOREIGN PATENT DOCUMENTS

| | | | |
|---|---|---|---|
| EP | 2848715 | B1 | 10/2018 |
| EP | 2993248 | B1 | 6/2020 |
| WO | 2019016041 | A1 | 1/2019 |
| WO | 2019076720 | A1 | 4/2019 |

OTHER PUBLICATIONS

VDA 238-100—Plate bending test for metallic materials, Jul. 2020.

European Search Report for EP Application No. 21205912 dated Mar. 29, 2022.

Hougardy, HP., Werkstoffkunde Stahl Band 1: Grundlagen, Verlag Stahleisen GmbH, Düsseldorf, 1984, p. 229.

*Primary Examiner* — Anthony M Liang

(74) *Attorney, Agent, or Firm* — RMCK Law Group PLC

(57) ABSTRACT

A flat steel product for production of a sheet metal component by hot forming includes a steel substrate consisting of a steel including 0.1-3% by weight of Mn and optionally up to 0.01% by weight of B, an aluminium-based coating disposed on at least one side of the steel substrate. A coating here has an applied layer weight of 15-30 g/m$^2$. In addition, the coating has an Al base layer consisting of 1.0-15% by weight of Si, optionally 2-4% by weight of Fe, 0.1-5.0% by weight of alkali metals or alkaline earth metals, and optional further constituents, the contents of which are limited to a total of not more than 2.0% by weight, and aluminium as the balance.

8 Claims, No Drawings

FLAT STEEL PRODUCT HAVING IMPROVED PROCESSING PROPERTIES

CROSS-REFERENCE TO RELATED APPLICATIONS

This application claims the benefit of European Patent Application No. 21205912.5 filed Nov. 2, 2021. The disclosure of the above application is incorporated herein by reference in its entirety.

The invention relates to a flat steel product for hot forming and to a process for producing such a flat steel product. The invention further relates to a shaped sheet metal article having improved processing properties and to a process for producing such a shaped sheet metal article from a flat steel product.

Where reference is made hereinafter to a "flat steel product" or else to a "sheet metal product", this means rolled products, such as steel strips or sheets, from which "sheet metal blanks" (also called blanks) are divided for the production of, for example, bodywork components. "Shaped sheet metal articles" or "sheet metal components" of the inventive type are produced from such sheet metal blanks, with synonymous use here of the terms "shaped sheet metal article" and "sheet metal component".

All figures relating to contents of the steel compositions specified in the present application are based on weight, unless explicitly stated otherwise. All otherwise indeterminate percentages associated with a steel alloy should therefore be regarded as figures in "% by weight". Apart from figures relating to the residual austenite content of the microstructure of a shaped sheet metal article of the invention that are based on volume (figure in "% by volume"), figures relating to the contents of the different microstructure constituents are each based on the area of a section of a sample of the respective product (figure in area percent, "area %"), unless explicitly stated otherwise. Figures given in this text in relation to the contents of the constituents of an atmosphere are based on volume (figure in "% by volume").

The microstructure was determined in longitudinal sections that had been subjected to etching with 3% nital (alcoholic nitric acid). The residual austenite content was determined by x-ray diffractometry.

Rising cost pressure in the automotive industry is leading to very precise examination of which properties are required in components that are installed in the car and which could actually be of lesser importance. Especially in the case of press-hardened components, this is leading to detailed consideration of the necessary corrosion protection performance. Crash-relevant and hence frequently press-hardened components are firstly not always in the wet region and are to some degree also encased by further sheet metal and plastic components, such that there is no need for any structural corrosion protection or any cosmetic corrosion protection of these components. Therefore, uncoated material is generally used for such components.

However, the press hardening (also referred to as hot forming) of uncoated material also brings disadvantages. For example, it is necessary to use a protective gas atmosphere in order to avoid excessive oxidation during hot forming. Moreover, surface characteristics, especially the friction value, of uncoated material leads to elevated tool wear in the hot forming tools. A further problem is additional logistics, since uncoated material, as described, must undergo another hot forming process.

EP 2 848 715 B1 proposed solving these problems by means of a thin electrolytic zinc layer on the material. However, this leads to roller soiling in the roller hearth furnace for hot forming and to liquid metal embrittlement.

Against this background, it is the object of the present invention to provide, for hot forming, an inexpensive material for applications with low propensity to corrosion that has improved processing properties.

The object is achieved by a flat steel product for production of a sheet metal component by hot forming, comprising a) a steel substrate consisting of a steel including 0.1-3% by weight of Mn and optionally up to 0.01% by weight of B, and b) an aluminium-based coating disposed on at least one side of the steel substrate.

The coating here has an applied layer weight of 15-30 g/m$^2$. In addition, the coating has an Al base layer consisting of 1.0-15% by weight of Si, optionally 2-4% by weight of Fe, 0.1-5.0% by weight of alkali metals or alkaline earth metals, and optional further constituents, the contents of which are limited to a total of not more than 2.0% by weight, and aluminium as the balance.

Much thicker coatings having a similar composition have to date been used solely for other applications. For example, EP 2 993 248 B1 details coatings having an applied layer weight of 120 g/m$^2$, in order to reduce penetration of water into the steel substrate during hot forming.

It has been recognized that, surprisingly, the low applied layer weight of the coating in conjunction with the addition of alkali metals or alkaline earth metals to the coating leads to improved processing properties. In particular, the result is elevated surface hardness after hot forming, which is manifested in lower tool wear to the forming tool even in the hot forming operation.

The addition of alkali metals and alkaline earth metals results in optimized oxide layer formation with >50% alkali metal and alkaline earth metal oxides, more preferably >60%, most preferably >70%. These oxide layers result, for example, in improved friction values. Moreover, altered roughness is formed as a result, which is advantageous with regard to paint adhesion and adhesive adhesion.

Furthermore, it has been found that the flat steel product described can be processed further with particular efficiency. Thus, the total time in the furnace in production of the shaped sheet metal article can be kept particularly low. Moreover, the further processing operation is not overly sensitive to variances in furnace temperature and total time in the furnace—there is thus a relatively generous process window that simplifies further processing.

The object of the invention is therefore especially also achieved by the use of an aluminium-based coating on at least one side of a steel substrate of a flat steel product for reduction of tool wear in the production of a sheet metal component by hot forming, especially at high and ultrahigh degrees of forming that occur in the production of bodywork components such as tunnel, B pillar or A pillar. The steel substrate here consists of a steel including 0.1-3% by weight of Mn and optionally up to 0.01% by weight of B. In addition, the coating has an applied layer weight of 15-30 g/m$^2$. Moreover, the coating has an Al base layer consisting of 1.0-15% by weight of Si, optionally 2-4% by weight of Fe, 0.1-5.0% by weight of alkali metals or alkaline earth metals, and optional further constituents, the contents of which are limited to a total of not more than 2.0% by weight, and aluminium as the balance.

According to the invention, the coating is disposed on at least one side of the steel substrate and has an applied layer weight of 15-30 g/m$^2$. The applied layer weight here is always based on one particular side of the flat steel product. In other words, the applied layer weight is 15-30 g/m$^2$ per side on which the coating is disposed. In the case of flat steel products having a corresponding coating on both sides, the total applied layer weight is thus 30-60 g/m$^2$. The two sides of the flat steel product refer to the two opposite large faces of the flat steel product. The narrow faces are referred to as edges.

In a preferred development of the flat steel product, the coating has an alloy layer that lies atop the steel substrate and atop which the Al base layer is disposed, where the alloy layer consists of 35-60% by weight of Fe, optional further constituents, the contents of which are limited to a total of not more than 5.0% by weight, and aluminium as the balance.

The alloy layer lies atop the steel substrate and directly adjoins it. The alloy layer is formed essentially from aluminium and iron. The other elements from the steel substrate or the melt composition do not accumulate significantly in the alloy layer. The alloy layer preferably consists of 35-60% by weight of Fe, preferably [illegible] -iron, optional further constituents, the contents of which are limited to a total of not more than 5.0% by weight, preferably 2.0%, and aluminium as the balance, where the Al content preferably rises in surface direction. The optional further constituents especially include the other constituents of the melt used in the production process (see below) (i.e. silicon and any alkali metals or alkaline earth metals, especially Mg and Ca), and the other components of the steel substrate in addition to iron.

The Al base layer lies atop the alloy layer and directly adjoins it. The composition of the Al base layer preferably corresponds to the composition of the melt in the melt bath. This means that it consists of 0.1-15% by weight of Si, optionally 2-4% by weight of Fe, 0.1-5% by weight of alkali metals or alkaline earth metals, preferably up to 1.0% by weight of alkali metals or alkaline earth metals and optional further constituents, the contents of which are limited to a total of not more than 2.0% by weight, and aluminium as the balance.

In a preferred variant of the Al base layer, the content of alkali metals or alkaline earth metals comprises 0.1-1.0% by weight of Mg, especially 0.1-0.7% by weight of Mg, preferably 0.1-0.5% by weight of Mg. In addition, the content of alkali metals or alkaline earth metals in the Al base layer can especially comprise at least 0.0015% by weight of Ca, especially at least 0.1% by weight of Ca.

In a preferred variant, the steel substrate has a proportion of diffusible hydrogen $H_{diff}$ of not more than 0.15 ppm % by weight. The diffusible hydrogen in the steel substrate should be determined here in the context of this application within 48 h after application of the coating.

The steel substrate is composed of a steel including 0.1-3% by weight of Mn and optionally up to 0.01% by weight of B. In particular, the microstructure of the steel is convertible by hot forming to a martensitic or partly martensitic microstructure. The microstructure of the steel substrate of the steel component is thus preferably a martensitic or at least partly martensitic microstructure, since this has a particularly high hardness.

More preferably, the steel substrate is a steel which, as well as iron and unavoidable impurities, consists (in % by weight) of C: 0.04-0.45% by weight
Si: 0.02-1.2% by weight
Mn: 0.5-2.6% by weight
Al: 0.02-1.0% by weight
P: ≤0.05% by weight
S: ≤0.02% by weight
N: ≤0.02% by weight
Sn: ≤0.03% by weight
As: ≤0.01% by weight
Ca: ≤0.005% by weight and optionally one or more of the elements "Cr, B, Mo, Ni, Cu, Nb, Ti, V, W" in the following contents:

Cr: 0.08-1.0% by weight
B: 0.001-0.005% by weight
Mo: ≤0.5% by weight
Ni: ≤0.5% by weight
Cu: ≤0.2% by weight
Nb: 0.02-0.08% by weight
Ti: 0.01-0.08% by weight
V: ≤0.1% by weight
W: 0.001-1.0% by weight.

The elements P, S, N, Sn, As, Ca are impurities that cannot be completely avoided in steelmaking. As well as these elements, it is also possible for further elements to be present as impurities in the steel. These further elements are combined among the "unavoidable impurities". Preferably, the content of unavoidable impurities adds up to not more than 0.2% by weight, preferably not more than 0.1% by weight. The optional alloy elements Cr, B, Nb, Ti for which a lower limit is given may also occur in contents below the respective lower limit as unavoidable impurities in the steel substrate. In that case, they are likewise counted among the unavoidable impurities, the total content of which is limited to not more than 0.2% by weight, preferably not more than 0.1% by weight. The individual upper limits for the respective impurity arising from these elements are preferably as follows:

Cr: ≤0.050% by weight
B: ≤0.0005% by weight
Nb: ≤0.005% by weight
Ti: ≤0.005% by weight These preferred upper limits should be considered here as alternatives or collectively. Preferred variants of the steel thus meet one or more of these four conditions.

In a preferred embodiment, the C content of the steel is not more than 0.37% by weight and/or at least 0.06% by weight. In particularly preferred execution variants, the C content is in the range of 0.06-0.09% by weight or in the range of 0.12-0.25% by weight or in the range of 0.33-0.37% by weight.

In flat steel products of the invention, carbon has a delaying effect on the formation of ferrite and bainite. At the same time, residual austenite is stabilized and the Ac3 temperature is reduced. A carbon content of at least 0.06% by weight is advantageous in order to assure the hardenability of the flat steel product and the tensile strength of the press-hardened product of at least 1000 MPa. If a higher strength level is the target, preference is given to establishing C contents of >0.12% by weight. If the C content is raised further to values of at least 0.19% by weight, it is possible, moreover, to improve hardenability, such that the flat steel product has a very good combination of hardenability and strength. Carbon contents greater than 0.45% by weight, however, have an adverse effect on the mechanical properties of the flat steel product, since carbon contents greater than 0.45% by weight during press hardening promote the formation of brittle martensite. High carbon contents can additionally adversely affect weldability. In order to improve weldability, the carbon content can preferably be adjusted to values of less than 0.40% by weight, especially 0.3% by weight. Especially in the case of carbon contents <0.25% by weight, weldability can be distinctly improved once again and, in addition, a good ratio of force absorption and maximum bending angle in the bending test according to VDA238-100 can be achieved in the press-hardened state.

In a preferred embodiment, the Si content of the steel is not more than 1.00% by weight and/or at least 0.06% by weight.

Silicon is used to further increase the hardenability of the flat steel product and the strength of the press-hardened product via solid solution strengthening. Silicon also enables the use of ferro-silico-manganese as an alloying agent, which has a favourable effect on production costs. Over and above an Si content of 0.06% by weight, a hardening effect is already established. Over and above an Si content of >0.15% by weight, a significant rise in strength occurs. Si contents above 0.5% by weight have an adverse effect on coating characteristics, especially in the case of Al-based coatings. Si contents of less than 0.4% by weight are preferably established in order to improve the surface quality of the coated flat steel product.

In a preferred variant, the Mn content of the steel is not more than 2.4% by weight and/or at least 0.75% by weight. In particularly preferred execution variants, the Mn content is in the range of 0.75-0.85% by weight or in the range of 1.0-1.6% by weight.

Manganese acts as a hardening element by greatly delaying ferrite and bainite formation. In the case of manganese contents of less than 0.5% by weight, ferrite and bainite are formed even in the case of very rapid cooling rates during press hardening, which should be avoided. Mn contents of greater than 0.75% by weight, especially 0.9% by weight, are preferred when a martensitic microstructure is to be assured, especially in regions of relatively high forming. Manganese contents greater than 3.0% by weight have an adverse effect on processing properties. In particular, weldability is greatly limited, and therefore the Mn content of flat steel products of the invention is limited to not more than 2.4% by weight, especially to not more than 1.6% by weight. Manganese contents of less than 1.6% by weight are additionally also preferred for economic reasons.

The Al content of the steel, in a preferred variant, is not more than 0.75% by weight, especially not more than 0.5% by weight, preferably not more than 0.25% by weight. Alternatively or additionally, the Al content is preferably at least 0.02%.

Aluminium is used as deoxidizing agent for binding of oxygen. In addition, aluminium inhibits cementite formation. For reliable binding of oxygen, at least 0.01% by weight of Al is required in the steel. But since the Ac3 temperature is also shifted distinctly upward with rising Al content in the alloy, the Al content is limited to 0.25% by weight. Over and above a content of 0.25% by weight, Al hinders transformation to austenite prior to press hardening to such a significant degree that austenitization can no longer be conducted in a time- and energy-efficient manner. For customary furnace temperatures between 850 and 950° C. in hot forming, an Al content of not more than 0.1% by weight should preferably be observed in order nevertheless to fully austenitize the steel.

In addition, it has been found that it can be helpful when the sum total of the contents of silicon and aluminium is limited. In a preferred variant, therefore, the sum total of the contents of Si and Al (typically referred to as Si+Al) is not more than 1.5% by weight, preferably not more than 1.2% by weight. Additionally or alternatively, the sum total of the contents of Si and Al is at least 0.06% by weight, preferably at least 0.08% by weight.

The elements P, S, N are typical impurities that cannot be completely avoided in steel making. In preferred variants, the P content is not more than 0.03% by weight. Independently thereof, the S content is preferably not more than 0.012%. Additionally or alternatively, the N content is preferably not more than 0.009% by weight.

Phosphorus (P) and sulfur (S) are elements that can be entrained into the steel as impurities resulting from iron ore and cannot be entirely eliminated in the industrial scale steelworks process. The P content and the S content should be kept as low as possible since mechanical properties, for example notched impact resistance, deteriorate with increasing P content or S content. Over and above P contents of 0.1% by weight, there is additionally increasing embrittlement of the martensite, and therefore the P content of a flat steel product of the invention is limited to <0.1% by weight, preferably not more than 0.03% by weight. The S content of a flat steel product of the invention is limited to <0.05% by weight, preferably not more than 0.012% by weight.

Nitrogen (N) is present in small amounts in the steel on account of the steel manufacturing process. The N content should be kept as low as possible and should be less than 0.02% by weight. Especially in the case of alloys containing boron, nitrogen is harmful since the formation of boron nitrides prevents the conversion-delaying effect of boron, and therefore the nitrogen content in this case should preferably be not more than 0.01% by weight, preferably not more than 0.009% by weight.

Optionally, the steel additionally contains chromium with a content of 0.08-1.0% by weight. Preferably, the Cr content is not more than 0.75% by weight, especially not more than 0.5% by weight.

Chromium is added to the steel of a flat steel product of the invention in contents of 0.08-1.0% by weight. Chromium influences the hardenability of the flat steel product by slowing diffusive conversion during press hardening. Over and above a content of 0.08% by weight, chromium in flat steel products of the invention has a favourable effect on hardenability, preference being given to a Cr content of >0.1% by weight for a reliable process regime, in particular for prevention of bainite formation. If the steel contains more than 1.0% by weight of chromium, there is a deterioration in the coating characteristics. In order to obtain a good surface quality, the Cr content can be limited preferably to not more than 0.75% by weight, especially not more than 0.5% by weight.

In the case of optional inclusion of chromium in the alloy, the sum total of the contents of chromium and manganese is preferably limited. The sum total is not more than 3.3% by weight, especially not more than 3.15% by weight. In addition, the sum total is at least 0.5% by weight, preferably at least 0.75% by weight.

Preferably, the steel optionally additionally contains boron with a content of 0.001-0.005% by weight. In particular, the B content is not more than 0.004% by weight.

Boron may optionally be included in the alloy in order to improve the hardenability of the flat steel product by reducing the grain boundary energy at boron atoms or boron precipitates adjoining the austenite grain boundaries, which suppresses the nucleation of ferrite during press hardening. A distinct effect on hardenability occurs in the case of B contents of at least 0.001% by weight. In the case of B contents exceeding 0.01% by weight, by contrast, there is increased formation of boron carbides, boron nitrides or boron nitrocarbides, which in turn constitute preferred nucleation sites for the nucleation of ferrite and further reduce the hardening effect. For that reason, the boron content is limited to not more than 0.01% by weight.

In the case of inclusion of boron in the alloy, titanium is preferably also included in the alloy for binding of nitrogen. The Ti content in that case should preferably be at least 3.42 times the content in % by weight of nitrogen.

Optionally, the steel may contain molybdenum with a content of not more than 0.5% by weight, especially not more than 0.1% by weight.

Molybdenum (Mo) may optionally be added to improve process stability since it distinctly slows ferrite formation. Over and above contents of 0.002% by weight, molybdenum-carbon clusters form dynamically to the extent of formation of ultrafine molybdenum carbides at the grain boundaries, which distinctly slow the mobility of the grain boundary and hence diffusive phase transformations. Moreover, molybdenum reduces the grain boundary energy, which reduces the nucleation rate of ferrite. On account of the high costs associated with an alloy of molybdenum, the Mo content should be not more than 1.0% by weight, preferably not more than 0.5% by weight.

Optionally, the steel may additionally contain copper with a content of not more than 0.2% by weight, preferably not more than 0.15% by weight.

Copper (Cu) may optionally be included in the alloy in order to increase hardenability in the case of contents of at least 0.01% by weight. In addition, copper improves resistance to atmospheric corrosion of uncoated sheets or cut edges. Over and above a content of 0.8% by weight, there is a distinct deterioration in hot rollability on account of low-melting Cu phases at the surface.

In addition, the steel may optionally contain nickel with a content of not more than 0.5% by weight, preferably not more than 0.15% by weight.

Nickel (Ni) stabilizes the austenitic phase and may optionally be included in the alloy in order to reduce the Ac3 temperature and to suppress the formation of ferrite and bainite. Nickel additionally has a positive influence on hot rollability, especially when the steel contains copper. Copper worsens hot rollability. In order to counteract the adverse effect of copper on hot rollability, it is possible to include in the alloy at least 0.01% by weight of nickel to the steel. For economic reasons, the nickel content should remain limited to contents of not more than 0.5% by weight, preferably not more than 0.4% by weight.

In addition, the steel may optionally contain one or more of the microalloy elements Nb, Ti and V. The optional Nb content here is at least 0.02% by weight and not more than 0.08% by weight, preferably not more than 0.04% by weight. The optional Ti content is at least 0.01% by weight and not more than 0.08% by weight, preferably not more than 0.04% by weight. The optional V content is not more than 0.1% by weight, preferably not more than 0.05% by weight.

Niobium (Nb) may optionally be included in the alloy in order to contribute to grain refining over and above a content of 0.001% by weight. However, niobium worsens the recrystallizability of the steel. In the case of an Nb content of more than 0.1% by weight, the steel can no longer be recrystallized in customary tunnel furnaces prior to hot-dip coating.

Titanium (Ti) is a microalloy element that can optionally be included in the alloy in order to contribute to grain refining. Moreover, titanium forms coarse titanium nitrides with nitrogen, and therefore the Ti content should be kept comparatively low. Titanium binds nitrogen and hence makes it possible for boron to display its strongly ferrite-inhibiting action. For sufficient binding of nitrogen, at least 3.42 times the nitrogen content is required, and at least 0.001% by weight of Ti should be added for sufficient availability. Over and above 0.1% by weight of Ti, there is a distinct deterioration in cold rollability and recrystallizability, and greater Ti contents should therefore be avoided.

In the case of optional inclusion of several of the elements Nb, Ti and V in the alloy, the sum total of the contents Nb, Ti and V is preferably limited. The sum total is not more than 0.1% by weight, especially not more than 0.068% by weight. In addition, the sum total is preferably at least 0.015% by weight.

Vanadium (V) is an element with high carbon affinity. When free vanadium is available, i.e. in the unbound or dissolved state, it can bind supersaturatedly dissolved carbon in the form of carbides or clusters or at least reduce its speed of diffusion. What is crucial here is that V is in the dissolved state. Surprisingly, very low V contents in particular have been found to be particularly favourable for ageing resistance. In the case of higher V contents, larger vanadium carbides can precipitate even at higher temperatures, and these then do not dissolve again at temperatures of 800-900° C. that are typical of continuous annealing operations in melt dip coating plants. Even very small amounts of vanadium of 0.001% by weight can already hinder deposition of free carbon at dislocations. Over and above a V content of 0.2% by weight, there is no further resultant improvement in ageing resistance through vanadium. The ageing-inhibiting effect of vanadium is particularly marked in the case of V contents of up to 0.009% by weight, with a maximum effect established over and above a preferred V content of 0.002% by weight. In the case of V contents greater than 0.009% by weight, there is increased formation of vanadium carbides. Vanadium carbides, over and above a vanadium content in steel of 0.009% by weight, cannot be dissolved at temperatures of 860° C. that are typical, for example, of annealing temperatures in a melt dip coating plant. The vanadium content of the steel in a flat steel product of the invention is firstly limited to not more than 0.1% by weight for reasons of cost. Secondly, higher V contents do not result in any significant improvement in mechanical properties.

Tungsten (W) may optionally be included in the alloy in contents of 0.001-1.0% by weight for slowing of ferrite formation. A positive effect on hardenability already arises in the case of W contents of at least 0.001% by weight. For reasons of cost, not more than 1.0% by weight of tungsten is included in the alloy.

The above elucidations relating to preferred steel substrates are of course likewise applicable to the steel substrate of the shaped sheet metal article described hereinafter, and to the steel substrates in the production processes described.

The process of the invention for production of a flat steel product for hot forming with a coating comprises the following steps:

a) providing a slab or a thin slab consisting of a steel having 0.1-3% by weight of Mn and optionally up to 0.01% by weight of B;
b) through-heating the slab or thin slab at a temperature (T1) of 1000-1400° C.;
c) optionally pre-rolling the through-heated slab or thin slab to give an intermediate product having an intermediate product temperature (T2) of 1000-1200° C.;
d) hot rolling to give a hot-rolled flat steel product, where the final rolling temperature (T3) is 750-1000° C.;

e) optionally winding the hot-rolled flat steel product, wherein the winding temperature (T4) is not more than 700° C.;

f) descaling the hot-rolled flat steel product;

g) optionally cold rolling the flat steel product, wherein the degree of cold rolling is at least 30%;

h) annealing the flat steel product at an annealing temperature (T5) of 650-900° C.;

i) cooling the flat steel product to a dipping temperature (T6) of 650-800° C., preferably 680-720° C.;

j) coating the flat steel product that has been cooled to the dipping temperature with a coating having an applied layer weight of 15-30 g/m$^2$ by i. dipping it into a melt bath having a melting temperature (T7) of 660-800° C., preferably 670-710° C.; and ii. blowing the flat steel product dry after it has exited from the melt bath by means of a gas stream with a flow pressure of 100-1000 mbar, preferably 200-750 mbar;

k) cooling the coated flat steel product to room temperature, where the first cooling time $t_{mT}$ in the temperature range between 600° C. and 450° C. is more than 10 s, especially more than 14 s, and the second cooling time $t_{nT}$ in the temperature range between 400° C. and 300° C. is more than 8 s, especially more than 12 s;

l) optionally skin pass rolling the coated flat steel product.

In step a), a semifinished product having a composition corresponding to the alloy defined in accordance with the invention for the flat steel product is provided. This may be a slab produced by the conventional slab casting method or by the thin slab casting method.

In step b), the semifinished product is through-heated at a temperature (T1) of 1000-1400° C. If the semifinished product should have cooled down after casting, the semifinished product is first reheated to 1000-1400° C. for through-heating. The through-heating temperature should be at least 1000° C. in order to ensure good formability for the downstream rolling process. The through-heating temperature should not be more than 1400° C. in order to avoid proportions of molten phases in the semifinished product.

In optional step c), the semifinished product is pre-rolled to give an intermediate product. Thin slabs are typically not subjected to any pre-rolling. Thick slabs that are to be rolled to hot strips may be subjected to pre-rolling if required. In this case, the temperature of the intermediate product (T2) at the end of the pre-rolling should be at least 1000° C. in order that the intermediate product contains sufficient heat for the subsequent step of finish rolling. High rolling temperatures, however, can also promote grain growth during the rolling operation, which has an adverse effect on the mechanical properties of the flat steel product. In order to keep grain growth low during the rolling operation, the temperature of the intermediate product at the end of the pre-rolling should not be more than 1200° C.

In step d), the slab or thin slab or, if step c) has been executed, the intermediate product is rolled to give a hot-rolled flat steel product. If step c) has been performed, the intermediate product is typically finish-rolled immediately after the pre-rolling. Typically, the finish rolling begins no later than 90 s after the end of the pre-rolling. The slab, the thin slab or, if step c) has been executed, the intermediate product are rolled at a final rolling temperature (T3). The final rolling temperature, i.e. the temperature of the finally hot-rolled flat steel product at the end of the hot rolling operation, is 750-1000° C. In the case of final rolling temperatures of less than 750° C., there is a decrease in the amount of free vanadium since greater amounts of vanadium carbides are deposited. The vanadium carbides deposited in the finish rolling are very large. They typically have an average grain size of 30 nm or more and are not dissolved again in subsequent annealing processes as conducted, for example, prior to melt dip coating. The final rolling temperature is limited to values of not more than 1000° C. in order to prevent coarsening of the austenite grains. Moreover, final rolling temperatures of not more than 1000° C. are of relevance for processing purposes in order to establish winding temperatures (T4) of less than 700° C.

The hot rolling of the flat steel product can be effected in the form of continuous hot strip rolling or in the form of reversing rolling. Step e) in the case of continuous hot strip rolling envisages optional winding of the hot-rolled flat steel product. For this purpose, the hot strip after the hot rolling is cooled down to a winding temperature (T4) within less than 50 s. The cooling medium used for this purpose may, for example, be water, air or a combination of the two. The winding temperature (T4) should be not more than 700° C. in order to avoid the formation of large vanadium carbides. There is in principle no lower limit to the winding temperature. However, winding temperatures of at least 500° C. have been found to be favourable for cold rollability. Subsequently, the wound hot strip is cooled down to room temperature in a conventional manner under air.

In step f), the hot-rolled flat steel product is descaled in a conventional manner by pickling or by another suitable treatment.

The descaled hot-rolled flat steel product, prior to the annealing treatment, can optionally be subjected to cold rolling in step g) in order, for example, to meet higher demands on the thickness tolerances of the flat steel product. The degree of cold rolling (DCR) should be at least 30% in order to introduce sufficient deformation energy for rapid recrystallization into the flat steel product. The degree of cold rolling DCR is understood here to mean the quotient of the decrease in thickness on cold rolling ΔtCR divided by hot strip thickness d:

$$DCR=\Delta tCR/d$$

with ΔtCR=decrease in thickness on cold rolling in mm and d=hot strip thickness in mm, where the decrease in thickness &CR is found from the difference in thickness of the flat steel product before cold rolling from the thickness of the flat steel product after cold rolling. The flat steel product before cold rolling is typically a hot strip of hot strip thickness d. The flat steel product after cold rolling is typically also referred to as cold strip. The degree of cold rolling may in principle assume very high values of more than 90%. However, degrees of cold rolling of not more than 80% have been found to be favourable for avoidance of strip breaks.

In step h), the flat steel product is subjected to an annealing treatment at annealing temperatures (T5) of 650-900° C. For this purpose, the flat steel product is first heated to the annealing temperature within 10 to 120 s and then kept at the annealing temperature for 30 to 600 s. The annealing temperature is at least 650° C., preferably at least 720° C. Annealing temperatures above 900° C. are undesirable for economic reasons.

In step i), the flat steel product is cooled down to a dipping temperature (T6) after the annealing in order to prepare it for the subsequent coating treatment. The pre-cooling temperature is lower than the annealing temperature and is matched to the temperature of the melt bath. The dipping temperature is 600-800° C., preferably at least 650° C., more preferably at least 680° C., more preferably not more than 700° C. The dipping temperature T6 is preferably not more than 750° C., especially not more than 720° C. For particularly homogeneous interfacial layer formation, it is important that there is sufficient thermal energy in the interfacial layer between steel substrate and aluminium melt. This is not the case at temperatures lower than 600° C., and so unwanted compounds can form, the later reconversion of which can lead to pores. Over and above the preferred dipping temperatures, there is another significant increase in the diffusion rate of iron into aluminium, such that, even at the start of the coating process, iron can diffuse to an increased degree into the still-liquid interfacial layer. The duration of cooling of the annealed flat steel product from the annealing temperature T5 to the dipping temperature T6 is preferably 10-180 s. In particular, the dipping temperature T6 differs from the temperature of the melt bath T7 by not more than 30K, especially not more than 20K, preferably not more than 10 K.

The flat steel product is subjected to a coating treatment in step j). The coating treatment is preferably effected by means of continuous melt dip coating. The coating may be applied only on one side, on both sides or on all sides of the flat steel product. The coating treatment is preferably effected as a melt dip coating process, especially as a continuous process. The flat steel product typically comes into contact with the melt bath on all sides, such that it is coated on all sides. The melt bath containing the alloy to be applied to the flat steel product in liquid form is typically at a temperature (T7) of 660-800° C., preferably 670-710° C. In particular, the melt temperature T7 is preferably at least 670° C., especially at least 680° C. In addition, the melt temperature is preferably not more than 750° C., especially not more than 730° C., preferably not more than 710° C. The melt bath preferably contains up to 15% by weight of Si, preferably more than 1.0% and optionally 2-4% by weight of Fe, 0.1-5.0% by weight of alkali metals or alkaline earth metals, preferably up to 1.0% by weight of alkali metals or alkaline earth metals, and optional further constituents, the contents of which are limited to a total of not more than 2.0% by weight, and aluminium as the balance. In a preferred variant, the Si content of the melt is 7-12% by weight, especially 8-10% by weight. In a preferred variant, the optional content of alkali metals or alkaline earth metals in the melt comprises 0.1-1.0% by weight of Mg, especially 0.1-0.7% by weight of Mg, preferably 0.1-0.5% by weight of Mg. In addition, the optional content of alkali metals or alkaline earth metals in the melt may especially comprise at least 0.0015% by weight of Ca, especially at least 0.01% by weight of Ca.

After exiting from the melt bath, the flat steel product is blown dry by means of a gas stream. A particularly advantageous gas stream here has been found to be one with a flow pressure of 100-1000 mbar, preferably 200-750 mbar. Since the viscosity of the melt and hence also the adhesion thereof on the flat steel product varies depending on the melt temperature T7, it is necessary to suitably adjust the flow pressure of the gas stream such that a coating having an applied layer weight of 15-30 g/m$^2$ remains on the flat steel product. It has been found that the combination of a melt temperature T7 of 670-710° C. with a flow pressure of 200-750 mbar is of particularly good suitability for this purpose.

After the coating treatment, the coated flat steel product is cooled down to room temperature in step k). A first cooling period $t_{mT}$ here within the temperature range between 600° C. and 450° C. (moderate temperature range MT) is more than 10 s, especially more than 14 s, and a second cooling period $t_{nT}$ within the temperature range between 400° C. and 300° C. (low temperature range LT) is more than 8 s, especially more than 12 s.

The first cooling period $t_{mT}$ within the temperature range between 600° C. and 450° C. (moderate temperature range MT) may be achieved here by means of slow continuous cooling or else by holding at a temperature for a certain time within this temperature range. There is even the possibility of intermediate heating. All that is important is that the flat steel product remains within the temperature range between 600° C. and 450° C. at least for a duration of cooling time $t_{mT}$. Within this temperature range, there is firstly a significant diffusion rate of iron into aluminium, and there is secondly inhibition of the diffusion of aluminium in steel, since the temperature is below half the melting temperature of steel. This enables diffusion of iron into the coating without significant diffusion of aluminium into the steel substrate.

The diffusion of iron into the coating has multiple advantages:

Firstly, the melting of the coating is delayed on austenitization before the press hardening. Secondly, there is homogenization of the coefficients of thermal expansion of coating and substrate. This means that the transition region between the coefficient of thermal expansion of substrate and surface becomes broader, which reduces thermal stresses on reheating.

At the same time, the diffusion of aluminium into the steel substrate would have considerable disadvantages: by virtue of the very high affinity of aluminium for nitrogen, a high aluminium content can have the effect that nitrogen is leached from fine deposits, such as niobium carbonitrides or titanium carbonitrides, and coarse precipitates are formed instead, such as aluminium nitrides, preferably at the grain boundaries. This would worsen crash performance and reduce the bending angle. Moreover, this destabilizes the fine precipitates (e.g. the niobium-containing precipitates) in the uppermost substrate region that are important for many preferred properties. Moreover, the inhomogeneous rate of diffusion of aluminium in the steel substrate into ferrite relative to perlite/bainite/martensite would lead to inhomogeneous distribution of Al in the boundary layer of the steel substrate. This should likewise be prevented for improvement of crash performance and bending performance. These disadvantages of diffusion of aluminium into the steel substrate are therefore reduced or avoided by inhibition.

By virtue of the preferred first cooling time $t_{mT}$ (14 s), there is an increase in the iron concentration in the transition interface layer to such an extent that this further reduces the activity of aluminium in the coating directly at the substrate boundary. This then leads to a further decrease in aluminium absorption into the substrate in the austenitization prior to the press hardening with the associated above-described advantages.

The second cooling time $t_{nT}$ in the temperature range between 400° C. and 300° C. (low temperature range LT) may likewise be achieved by slow continuous cooling or else by holding at a temperature for a certain time within this temperature range. There is even the possibility of intermediate heating. All that is important is that the flat steel product remains within the temperature range between 400° C. and 300° C. at least for a duration of cooling time tnT.

Within this temperature range, there is still a certain diffusion rate of carbon in the steel substrate, while the thermodynamic solubility is very low. Thus, carbon diffuses to lattice defects and collects there, for example at dissolved Nb atoms. By virtue of their distinctly higher atomic volume, these expand the atomic lattice and hence increase the size of the tetrahedral and octahedral gaps in the atomic lattice, such that the local solubility of C is increased. This results in clusters of C and Nb, which are then converted in the austenitization step of the hot forming to give very fine precipitates and lead to a refined austenite microstructure and hence also hardening microstructure, and in a reduction in the free hydrogen content.

With the preferred hold time of more than 12 s, there is additionally formation of very fine iron carbides (called transition carbides) that dissolve again very rapidly on austenitization and lead to additional austenite seeds and hence to an even finer austenite microstructure and hence also hardening microstructure.

The coated flat steel product may optionally be subjected to skin pass rolling with a degree of skin pass rolling of up to 2% in order to improve the surface roughness of the flat steel product.

In a preferred development of the process, the gas stream is an air stream that preferably has a temperature of room temperature to 130° C., preferably of 50-90° C. The temperature ranges mentioned have been found to be particularly appropriate in order to suitably influence the surface temperature of the coating. On the one hand, excessively rapid solidification of the surface is prevented, such that sufficient diffusion can still take place. On the other hand, the surface of the coating is cooled down a little in order to prevent adhesion to downstream rollers as a result of mobile phases of the coating.

In a preferred development of the process, the dew point temperature TP in the through-heating performed in step b) is 30-80° C., on account of the flames from the burners used for through-heating.

In a further preferred development of the process, the lambda value of an annealing atmosphere in the through-heating performed in step b) is 0.95-1.1.

The lambda value (also combustion air ratio) describes the ratio of the masses of air to fuel introduced into the tunnel furnace.

The invention further relates to a shaped sheet metal article, especially formed from an above-described flat steel product comprising an above-elucidated steel substrate and an aluminium-based coating disposed on at least one side of the steel substrate. The coating here has an applied layer weight of 15-30 g/m$^2$ and consists of 1-15% by weight of Si, 15-35% by weight of Fe, 0.1-5% by weight of alkali metals or alkaline earth metals, and optional further constituents, the contents of which are limited to a total of not more than 2.0% by weight, and aluminium as the balance. In conjunction with the low applied layer weight, the composition leads to elevated surface hardness, which is already manifested in lower tool wear to the forming tool in the hot forming operation.

In a preferred variant, the Si content of the coating is at least 6% by weight, especially at least 7.0% by weight. Further preferably, the Si content of the coating is not more than 9% by weight, preferably not more than 8.0% by weight. Independently thereof, the Fe content is preferably at least 20% by weight, preferably at least 23% by weight, especially at least 25% by weight. In addition, the Fe content is not more than 30% by weight, preferably not more than 29% by weight, especially not more than 28.0% by weight. In a preferred variant, the content of alkali metals or alkaline earth metals comprises 0.1-1.0% by weight of Mg, especially 0.1-0.7% by weight of Mg, preferably 0.1-0.5% by weight of Mg. In addition, the content of alkali metals or alkaline earth metals in the Al base layer may especially comprise at least 0.0015% by weight of Ca, especially at least 0.1% by weight of Ca.

In a specific embodiment, the coating of the shaped sheet metal article has an Al base layer and an alloy layer, where the alloy layer lies atop the steel substrate and the Al base layer lies atop the alloy layer.

The alloy layer of the shaped sheet metal article preferably consists of 35-90% by weight of Fe, 0.1-10% by weight of Si, optionally up to 0.5% by weight of Mg and optional further constituents, the contents of which are limited to a total of not more than 2.0% by weight, and aluminium as the balance. The further diffusion of iron into the alloy layer means that the proportions of Si and Mg are correspondingly lower than their respective proportion in the melt in the melt bath.

The alloy layer preferably has a ferritic microstructure.

The alloy layer of the shaped sheet metal article preferably has a thickness corresponding to 60-95% of the thickness of the coating, especially 70-90% of the thickness of the coating.

The Al base layer of the shaped sheet metal article lies atop and directly adjoins the alloy layer of the steel component. Preferably, the Al base layer of the steel component consists of up to 55% by weight of Fe, 0.4-10% by weight of Si, optionally up to 0.5% by weight of Mg and optional further constituents, the contents of which are limited to a total of not more than 2.0% by weight, and aluminium as the balance. The optional content of Mg is preferably more than 0.1% by weight.

The Al base layer may have a homogeneous element distribution in which the local element contents vary by not more than 10%. Preferred variants of the Al base layer, by contrast, have low-silicon phases and silicon-rich phases. Low-silicon phases here are areas wherein the average Si content is at least 20% less than the average Si content of the Al base layer. Silicon-rich phases here are areas wherein the average Si content is at least 20% more than the average Si content of the Al base layer.

In a preferred variant, the silicon-rich phases are disposed within the low-silicon phase. In particular, the silicon-rich phases form at least a 40% continuous layer bounded by low-silicon regions. In an alternative execution variant, the silicon-rich phases are in an insular arrangement in the low-silicon phase.

What is meant by "insular" in the context of this application is an arrangement in which discrete non-coherent regions of another material are surrounded—i.e. there are "islands" of a particular material in another material.

In a preferred variant, the steel component has an oxide layer disposed on the coating. The oxide layer here is especially atop the Al base layer and preferably forms the outer conclusion of the coating.

The oxide layer of the steel component especially consists to an extent of more than 80% by weight of oxides, where the main component of the oxides (i.e. more than 50% by weight of the oxides, especially more than 70%, preferably more than 80%) are alkali metal and alkaline earth metal oxides (preferably Mg oxides). Optionally present in the oxide layer in addition to the oxides of the alkali metals and alkaline earth metals are hydroxides and/or aluminium oxide, alone or as a mixture. The remainder of the oxide layer which is not occupied by the oxides and optionally present hydroxides preferably consists of silicon, aluminium, iron and/or the alkali metals and alkaline earth metals (preferably magnesium) in metallic form.

The oxide layer preferably has a thickness of at least 50 nm, especially of at least 100 nm. In addition, the thickness is not more than 4 μm, especially not more than 2 μm.

In a preferred variant of the shaped sheet metal article, the Al base layer has a nano hardness of at least 1.3 GPa (gigapascal), especially at least 1.4 GPa. For minimization of tool wear, a maximum nano hardness of 1.8 GPa should preferably not be exceeded either. Preferably, the Al base layer additionally has an indentation modulus of at least 79 GPa, preferably at least 82 GPa, especially at least 84 GPa. The indentation modulus is preferably not more than 105 GPa, especially not more than 100 GPa.

In the context of this application, nano hardness and indentation modulus are determined with a nano-indenter with a Berkovich pyramid as testing tip. For this purpose, a section is created and then the corresponding layer is indented. For the softer Al base layer, the measurement is conducted with a load function with a maximum load of 200 μN. For the harder alloy layer and the near-surface region of the steel substrate, the measurement is conducted with a load function having a maximum load of 2000 μN.

In a preferred variant of the shaped sheet metal article, the alloy layer has a nano hardness of at least 10.9 GPa, preferably at least 11.0 GPa, especially at least 11.5 GPa. The maximum nano hardness should preferably not exceed 16 GPa. The alloy layer preferably additionally has an indentation modulus of at least 175 GPa, preferably at least 180 GPa, especially at least 185 GPa. The indentation modulus is preferably not more than 250 GPa, especially not more than 230 GPa.

In a preferred variant of the shaped sheet metal article, the near-surface region of the steel substrate has a nano hardness of at least 10.9 GPa, preferably at least 11.0 GPa, especially at least 12.0 GPa. The maximum nano hardness should not exceed 17 GPa, preferably 16 GPa. Preferably, the near-surface region of the steel substrate additionally has an indentation modulus of at least 205 GPa, preferably at least 180 GPa, especially at least 185 GPa. The indentation modulus is preferably not more than 280 GPa, especially not more than 260 GPa.

It has been found that the values thus established for the two layers and the near-surface region of the steel substrate have particularly positive effects on forming characteristics in the forming tool. In the forming tool, there should on the one hand be a minimum level of abrasive wear in order for there to be a minimum level of tool damage. On the other hand, it should not be too soft in order to avoid sticking to the forming tool. The abovementioned values have been found here to be a good compromise.

In the context of this application, the near-surface region of the steel substrate is understood to mean the strip having a thickness of 20 μm that directly adjoins the alloy layer. In other words, the near-surface region of the steel substrate means the uppermost 20 μm of the steel substrate.

In a specific development, the steel substrate of the shaped sheet metal article has a microstructure having at least to some degree more than 80% martensite, preferably at least to some degree more than 90% martensite, especially at least to some degree more than 95%, more preferably at least to some degree more than 99%. What is meant by "have to some degree" in this connection is that there are regions of the shaped sheet metal article that have the microstructure mentioned. In addition, there may also be regions of the shaped sheet metal article that have a different microstructure. The shaped sheet metal article thus has sections or regions of the microstructure mentioned.

By virtue of the high martensite content, it is possible to achieve very high tensile strengths and yield points.

The shaped sheet metal article of the invention is preferably a component for a land vehicle, watercraft or aircraft. It is more preferably an automobile part, especially a bodywork part; the component is preferably a B pillar, longitudinal beam, A pillar, sill or transverse beam.

The process of the invention for producing a shaped sheet metal article of the invention that has been created in the manner elucidated above involves at least the following steps:

a) providing a sheet metal blank from an above-elucidated flat steel product;

b) heating the sheet metal blank such that the AC3 temperature of the blank has been exceeded at least to some degree and the temperature $T_{ins}$ of the blank on insertion into a forming tool intended for hot press forming (step c)) at least to some degree has a temperature above Ms+100° C., where Ms denotes the martensite start temperature;

c) inserting the heated sheet metal blank into a forming tool, wherein the transfer time $t_{trans}$ required for the removal from the heating device and the insertion of the blank is not more than 20 s, preferably not more than 15 s;

d) hot press forming the sheet metal blank to give the shaped sheet metal article, wherein the blank, in the course of the hot press forming, is cooled down over a period $t_{WZ}$ of more than 1 s at a cooling rate $r_{WZ}$ which is at least partly more than 30 K/s to the target temperature $T_{target}$ and is optionally kept at that temperature;

e) removing the shaped sheet metal article that has been cooled down to the target temperature from the tool.

In the process of the invention, a blank consisting of a flat steel product of suitable composition corresponding to the above elucidations is thus provided (step a)), which is then heated in a known manner per se in such a way that the AC3 temperature of the steel is at least partly exceeded and the temperature of the blank on insertion into a forming tool intended for hot press forming (step c)) at least to some degree has a temperature above Ms+100° C., preferably AC1. Partial exceedance of a temperature (here AC3 or Ms+100° C.) in the context of this application is understood to mean that at least 30%, especially at least 60%, of the volume of the blank exceeds a corresponding temperature. On insertion into the forming tool, at least 30% of the blank thus has an austenitic microstructure, i.e. the transformation from the ferritic to the austenitic microstructure need not have concluded on insertion into the forming tool. Instead, up to 70% of the volume of the blank on insertion into the forming tool may consist of different microstructure constituents, such as tempered bainite, tempered martensite and/or non-recrystallized or partly recrystallized ferrite. For this purpose, particular regions of the blank may be kept at a lower temperature level from others in a controlled manner during the heating. For this purpose, the supply of heat may be directed in a controlled manner solely to particular sections of the blank, or the parts that are to be heated less are shielded from the supply of heat. In the part of the blank material wherein the temperature remains lower, only a distinctly lower level of martensite, if any, is formed in the course of forming in the tool, such that the microstructure there is much softer than in the respective other parts in which there is a martensitic microstructure. In this way, it is possible in the respectively formed shaped sheet metal article to establish a softer region in a controlled manner in that, for example, there is an optimal toughness for the respective end use, while the other regions of the shaped sheet metal article have maximized strength.

Maximum strength properties of the resultant shaped sheet metal article may be enabled in that the temperature attained at least to some degree in the sheet metal blank is between Ac3 and 1000° C., preferably between 850° C. and 950° C.

The minimum temperature Ac3 to be exceeded here is determined by the formula specified by HOUGARDY, HP. in Werkstoffkunde Stahl Band 1: Grundlagen [Materials; Steel; Volume 1: Principles], Verlag Stahleisen GmbH, Düsseldorf, 1984, p. 229:

$$Ac3=(902-225*\%\ C+19*\%\ Si-11*\%\ Mn-5*\%\ Cr+13*\%\ Mo-20*\%\ Ni+55*\%\ V)^\circ\ C.$$

with % C=respective C content, % Si=respective Si content, % Mn=respective Mn content, % Cr=respective Cr content, % Mo=respective Mo content, % Ni=respective Ni content and % V=respective V content of the steel of which the blank consists.

An optimally uniform distribution of properties can be achieved in that the blank is fully through-heated in step b).

In a preferred execution variant, the average heating rate $r_{furnace}$ of the sheet metal blank on heating in step b) is at least 3 K/s, preferably at least 5 K/s, especially at least 10 K/s, preferably at least 15 K/s. The average heating rate $r_{furnace}$ here is the average heating rate from 30° C. to 700° C.

In a preferred execution variant, the heating is effected in a furnace having a furnace temperature $T_{furnace}$ of at least 850° C., preferably at least 880° C., more preferably at least 900° C., especially at least 920° C., and not more than 1000° C., preferably not more than 950° C., more preferably not more than 930° C.

Preferably, the dew point in the furnace is at least −20° C., preferably at least −15° C., especially at least −5° C., preferably at least 0° C., more preferably at least 5° C. and not more than +25° C., preferably not more than +20° C., especially not more than +15° C.

In a specific execution variant, the heating in step b) is effected stepwise in regions with different temperature. In particular, the heating is effected in a roller hearth furnace with different heating zones. The heating is effected here in a first heating zone with a temperature (so-called furnace entry temperature) of at least 650° C., preferably at least 680° C., especially at least 720° C. The temperature in the first heating zone is preferably not more than 900° C., especially not more than 850° C. Further preferably, the maximum temperature of all heating zones in the furnace is not more than 1200° C., especially not more than 1000° C., preferably not more than 950° C., more preferably not more than 930° C.

The total time in the furnace $t_{furnace}$, composed of a heating time and a hold time, in both variants (constant furnace temperature, stepwise heating), for sheet metal thicknesses of 1.5 mm or less, is preferably at least 1 minute, preferably at least 2 minutes. In addition, the total time in the furnace in the case of such metal sheets in both variants is preferably not more than 10 minutes, especially not more than 8 minutes, preferably not more than 6 minutes, more preferably not more than 4 minutes.

In the case of sheet metal thicknesses of more than 1.5 mm (especially up to a sheet metal thickness of 5 mm), the total time in the furnace $t_{furnace}$ is especially at least 1.5 minutes, preferably at least 2 minutes, preferably at least 3 minutes. In addition, the total time in the furnace, in the case of such metal sheets, in both variants, is preferably not more than 12 minutes, especially not more than 10 minutes, preferably not more than 8 minutes, more preferably not more than 6 minutes.

Longer total times in the furnace have the advantage that uniform austenitization of the sheet metal blank is assured. On the other hand, holding above Ac3 for too long a period leads to grain coarsening, which has an adverse effect on mechanical properties.

The blank which has thus been heated is removed from the respective heating device, which may, for example, be a conventional heating furnace, an induction heating device which is likewise known per se, or a conventional device for keeping steel components hot, and transported into the forming tool with sufficient speed that its temperature on arrival in the tool is at least partly above Ms+100° C., preferably above 600° C., especially above 650° C., more preferably above 700° C. Ms here denotes the martensite start temperature. In a particularly preferred variant, the temperature is at least partly above the AC1 temperature. In all these variants, the temperature is especially not more than 900° C. These temperature ranges assure good formability of the material overall.

In step c), the transfer of the austenitized blank from the respectively used heating device to the forming tool is performed within preferably not more than 20 s, especially not more than 15 s. Such rapid transport is required in order to avoid excessive cooling prior to shaping.

The tool on insertion of the blank is typically at a temperature between room temperature (RT) and 200° C., preferably between 20° C. and 180° C., especially between 50° C. and 150° C. Optionally, the tool, in a particular embodiment, may be heated at least in regions to a temperature $T_{WZ}$ of at least 200° C., especially at least 300° C., in order to only partially harden the component. In addition, the tool temperature $T_{WZ}$ is preferably not more than 600° C., especially not more than 550° C. All that should be ensured is that the tool temperature $T_{WZ}$ is below the desired target temperature $T_{target}$. The dwell time in the tool $t_{WZ}$ is preferably at least 2 s, especially at least 3 s, more preferably at least 5 s. The dwell time in the tool is preferably not more than 25 s, especially not more than 20 s.

The target temperature $T_{target}$ of the shaped sheet metal article is at least to some degree below 400° C., preferably below 300° C., especially below 250° C., preferably below 200° C., more preferably below 180° C., especially below 150° C. Alternatively, the target temperature $T_{target}$ of the shaped sheet metal article is more preferably below Ms−50° C., where Ms denotes the martensite start temperature. In addition, the target temperature of the shaped sheet metal article is preferably at least 20° C., more preferably at least 50° C.

The martensite start temperature of a steel within the provisions of the invention should be calculated by the formula $$Ms\ [^\circ\ C.]=(490.85-302.6\%\ C-30.6\%\ Mn-16.6\%\ Ni-8.9\%\ Cr+2.4\%\ Mo-11.3\%\ Cu+8.58\%\ Co+7.4\%\ W-14.5\%\ Si)[^\circ\ C./\%\ by\ wt.]$$

where, here too, C % denotes the C content, % Mn the Mn content, % Mo the Mo content, % Cr the Cr content, % Ni the Ni content, % Cu the Cu content, % Co the Co content, % W the W content and % Si the Si content of the respective steel in % by weight.

The AC1 temperature and the AC3 temperature of a steel within the provisions of the invention should be calculated by the formulae AC1[° C.]=(739−22*% C−7*% Mn+2*% Si+14*% Cr+13*% Mo−13*% Ni+20*% V)[° C./% by wt.]

AC3[° C.]=(902−225*% C+19*% Si−11*% Mn−5*% Cr+13*% Mo−20*% Ni+55*% V)[° C./% by wt.]

where, here too, % C denotes the C content, % Si the Si content, % Mn the Mn content, % Cr the Cr content, % Mo the Mo content, % Ni the Ni content and +% V the vanadium content of the respective steel (Brandis H 1975 TEW-Techn. Ber. 1 8-10).

In the tool, the blank is thus not just shaped to give the shaped sheet metal article, but simultaneously also quenched to the target temperature. The cooling rate in the tool $r_{WZ}$ to the target temperature is especially at least 20 K/s, preferably at least 30 K/s, especially at least 50 K/s, in a particular execution at least 100 K/s.

The removal of the shaped sheet metal article in step e) is followed by cooling of the shaped sheet metal article to a cooling temperature $T_{AB}$ of less than 100° C. within a cooling time $t_{AB}$ of 0.5 to 600 s. This is generally accomplished by air cooling.

The invention is elucidated in detail hereinafter by working examples.

Multiple experiments were conducted to show the efficacy of the invention. For this purpose, slabs having the compositions specified in Table 1, having a thickness of 240 mm and width of 1200 mm were produced, and heated up in a pusher furnace to a temperature T1 specified in Table 5. On heating, the dew points and lambda values were as specified in Table 5. Subsequently, the slabs were kept at T1 for between 30 and 450 min, until the temperature T1 has been attained in the core of the slabs and the slabs were thus heated through. The slabs with their respective through-heating temperature T1 were discharged from the pusher furnace and subjected to hot rolling. The experiments were conducted as continuous hot strip rolling. For this purpose, the slabs were first pre-rolled to an intermediate product of thickness 40 mm, and the intermediate products, which can also be referred to as preliminary strips in hot strip rolling, each had an intermediate product temperature T2 of 1100° C. at the end of the pre-rolling phase. The preliminary strips, immediately after the pre-rolling, were sent to finish rolling, such that the intermediate product temperature T2 corresponds to the roller start temperature for the finish rolling phase. The preliminary strips were rolled to give hot strips having a final thickness of 4 mm and a final rolling temperature T3 of 890° C., cooled down to the respective winding temperature and wound up at a winding temperature T4 of 580° C. to give coils and then cooled down in stationary air. The hot strips were descaled by means of pickling in a conventional manner before being subjected to a cold rolling operation, resulting in the thickness given in Table 4. The cold-rolled flat steel products were heated in a continuous annealing furnace to an annealing temperature T5 of 870° C. and kept at the annealing temperature for 100 s in each case, before being cooled down at a cooling rate of 1 K/s to the dipping temperature T6 specified in Table 3. The cold strips, at their respective dipping temperature T6, were guided through a molten coating bath at temperature T7. The strip speed in all cases was 76 m/min. The composition of the coating bath is specified in Table 2. After the coating, the coated strips were blown dry in order to establish the applied layer weights. For this purpose, an air stream with a flow pressure specified in Table 3 was used. The temperature of the air stream in all cases was 70° C. The strips were first cooled down to 600° C. at an average cooling rate of 10-15 K/s. Later in the cooling procedure, between 600° C. and 450° C. and between 400° C. and 300° C., the strips were cooled down over the cooling periods TmT of 18 s and TnT of 15 s. Between 450° C. and 400° C. and below 220° C., the strips were cooled down at a cooling rate of 5-15 K/s in each case.

Table 6 is a compilation of what steel type (see Table 1) was combined with what coating variant (see Table 2), what production variant (see Table 3), what preheating variant (see Table 5) and what dimensions (see Table 4). In addition, Table 6 states the proportion of diffusible hydrogen in the steel substrate of the flat steel product thus produced. This proportion is reported in ppm. 1 ppm corresponds here to a proportion of 0.0001% by weight.

Production variant E4 and hence experiment T5 is a reference example that is not in accordance with the invention.

Blanks were divided from each of the steel strips thus produced, and these were used for further experiments. In these experiments, shaped sheet metal article samples 1-9 in the form of plates of size 200×300 mm$^2$ have been obtained by hot press forming from the respective blanks. For this purpose, the blanks have been heated in a heating device, for example in a conventional heating furnace, from room temperature at an average heating rate $r_{furnace}$ of 6 K/s (in the temperature range between 30° C. and 700° C.) in a furnace with a furnace temperature $T_{furnace}$ of 920° C. The total time in the furnace, comprising heating and holding, is defined as $t_{furnace}$ and is reported in Table 7. Subsequently, the blanks are taken from the heating device and inserted into a forming tool heated to room temperature RT. On removal from the furnace, the blanks had assumed the furnace temperature. The transfer time, composed of that for removal from the heating device, transport to the tool and insertion into the tool, was about 10 s. The temperature of the blanks on insertion into the forming tool in all cases was above the respective AC1 temperature. The forming tool had a temperature $T_{WZ}$ of 60° C. The blanks have been formed in the forming tool to the respective shaped sheet metal article, and the shaped sheet metal articles have been cooled in the tool at a cooling rate $r_{WZ}$ of 50 K/s. Finally, the samples have been cooled down to room temperature. The cooling was effected here under stationary air at a cooling rate of 7 K/s.

Table 7 additionally states the properties of the shaped sheet metal articles thus obtained. The applied layer weights in all variants of the invention were between 20.0 and 22.0 g/m$^2$.

Chemical analysis of the overall coating for the inventive experiments gave Si contents between 7.5% and 8.0% by weight, Fe contents between 25% and 28% by weight, and Mg contents between 0.19% and 0.21% by weight. By comparison, reference example T5 has a much lower Fe content, but higher proportions of Si and Mg. Based on the higher applied layer weight and hence layer thickness, the diffusion of Fe into the coating in reference example T5 is much less advanced, even though the time in the furnace ($t_{furnace}$) was distinctly prolonged by comparison with the inventive examples. Although reference example T10 likewise has a lower applied layer weight of 20.3 g/m$^2$, it has no alkali metals or alkaline earth metals in the coating. It is clearly apparent that the hardness values in the coating are then lower.

As well as chemical analysis, the coating was also analysed in cross section. All experiments here showed a construction with an Al base layer and an alloy layer, with the alloy layer lying atop the steel substrate and the Al base layer lying atop the alloy layer.

The sections produced were also analysed specifically for their hardness. For this purpose, the Al base layer, the alloy layer and the near-surface substrate region were tested separately. In the analysis with a nano-indenter, nano hardness and indentation modulus were determined. This was done using a Berkovich pyramid as testing tip. For the softer Al base layer, the measurement was conducted with a load function having a maximum load of 200 μN. For the hard alloy layer and the near-surface region of the steel substrate, the measurement was conducted with a load function having a maximum load of 2000 μN. It is clearly apparent that, in all three regions, harder structures have been established in the samples of the invention than in the reference example.

In addition, the microstructure of the steel substrate was ascertained from the cross sections. In all cases, a martensite content of more than 95 area % was found.

TABLE 1

(steel types)

| Steel | C | Si | Mn | P | S | Al | Nb | Ti | B |
|---|---|---|---|---|---|---|---|---|---|
| S1 | 0.21 | 0.25 | 1.12 | 0.015 | 0.002 | 0.03 | — | 0.02 | 0.003 |
| S2 | 0.34 | 0.24 | 1.20 | 0.011 | 0.001 | 0.025 | — | 0.04 | 0.004 |
| S3 | 0.37 | 0.30 | 1.25 | 0.005 | 0.001 | 0.04 | — | 0.03 | 0.003 |

Balance: iron and unavoidable impurities. Figures in % by weight in each case;

TABLE 2

(coating variant)

| Coating | Melt analysis | | | | |
|---|---|---|---|---|---|
| variant | Si | Mg | Fe | Others | Al |
| B1 | 9.6 | 0.23 | 3.2 | <1% | balance |
| B2 | 9.6 | 0.25 | 3.1 | <1% | balance |
| B3 | 9.7 | 0.3 | 2.9 | <1% | balance |
| B4 | 9.3 | — | 3.3 | <1% | balance |

TABLE 3

(production parameters for coating)

| Production variant | T6 [° C.] | T7 [° C.] | Flow pressure [mbar] | Speed [m/min] |
|---|---|---|---|---|
| E1 | 701 | 685 | 200 | 76 |
| E2 | 713 | 689 | 250 | 76 |
| E3 | 690 | 676 | 300 | 76 |
| E4 | 670 | 680 | 45 | 76 |

TABLE 4

(dimensions)

| Dimension variant | Thickness [mm] | Width [mm] | Length [m] |
|---|---|---|---|
| A1 | 0.80 | 1250 | 2230 |
| A2 | 1.50 | 1250 | 1600 |
| A3 | 2.85 | 1250 | 1600 |

TABLE 5

(preheating parameters)

| Preheating variant | T1 [° C.] | Lambda | Dew point [° C.] |
|---|---|---|---|
| V1 | 1100 | 1.05 | 60 |
| V2 | 1250 | 0.98 | 60 |
| V3 | 1150 | 1.08 | 60 |
| V4 | 1000 | 1.15 | 60 |

TABLE 6

(overview of experiments)

| Experiment No. | Steel type | Coating variant | Pre-heating variant | Production variant | Dimension variant | $H_{diff}$ [ppm] |
|---|---|---|---|---|---|---|
| T1 | S1 | B1 | V1 | E1 | A2 | 0.12 |
| T2 | S2 | B2 | V1 | E2 | A1 | 0.12 |
| T3 | S3 | B3 | V2 | E3 | A3 | 0.12 |
| T4 | S1 | B1 | V3 | E2 | A2 | 0.11 |
| T5* | S2 | B2 | V1 | E4 | A2 | 0.08 |
| T6 | S2 | B1 | V4 | E2 | A2 | 0.13 |
| T7 | S2 | B3 | V1 | E3 | A2 | 0.11 |
| T8 | S3 | B1 | V2 | E1 | A2 | 0.12 |
| T9 | S3 | B1 | V3 | E3 | A2 | 0.12 |
| T10 | S1 | B4 | V1 | E2 | A2 | 0.14 |

*noninventive reference examples

TABLE 7

(overview of experimental results)

| Test | Layer weight applied per side in g/m² | Coating composition [% by wt.] Si | Fe | Mg | Others | Al | $t_{furnace}$ [s] | Property of the Al base layer | Property of the alloy layer | Properties of near-surface substrate region |
|---|---|---|---|---|---|---|---|---|---|---|
| | | | | | | | | Nano hardness/indentation modulus in GPa | | |
| T1 | 20.8 | 7.70 | 26.5 | 0.19 | <1.0 | balance | 115 | 1.4/79 | 10.9/181 | 10.9/205 |
| T2 | 21 | 7.72 | 27.7 | 0.2 | <1.0 | balance | 110 | 1.5/88 | 11.0/182 | 12.3/214 |
| T3 | 21.6 | 7.67 | 25.2 | 0.21 | <1.0 | balance | 120 | 1.3/85 | 11.7/190 | 13.7/224 |
| T4 | 22.4 | 7.62 | 27.2 | 0.2 | <1.0 | balance | 120 | 1.4/84 | 12.2/191 | 12.8/218 |
| T5* | 60 | 8.10 | 10.6 | 0.29 | <1.0 | balance | 180 | 1.2/77 | 10.7/169 | 10.8/200 |
| T6 | 20.5 | 7.62 | 25.6 | 0.195 | <1.0 | balance | 120 | 1.4/89 | 11.8/190 | 12.9/223 |
| T7 | 20 | 7.73 | 26.2 | 0.197 | <1.0 | balance | 110 | 1.3/80 | 12.0/185 | 12.4/215 |

TABLE 7-continued (overview of experimental results)

| Test | Layer weight applied per side in g/m² | Coating composition [% by wt.] Si | Fe | Mg | Others | Al | $t_{furnace}$ [s] | Property of the Al base layer | Property of the alloy layer | Properties of near-surface substrate region |
|---|---|---|---|---|---|---|---|---|---|---|
| | | | | | | | | Nano hardness/indentation modulus in GPa | | |
| T8 | 21 | 7.65 | 25.7 | 0.19 | <1.0 | balance | 110 | 1.4/85 | 11.9/181 | 12.3/215 |
| T9 | 21.1 | 7.71 | 27.1 | 0.2 | <1.0 | balance | 110 | 1.3/82 | 11.7/182 | 11.2/210 |
| T10 | 20.3 | 7.65 | 25.9 | 0 | <1.0 | balance | 110 | 1.1/75 | 10.1/175 | 10.9/210 |

*noninventive reference examples

The invention claimed is:

1. A shaped sheet metal article, formed from a flat steel product made by a process comprising the following steps:

a) providing a slab or a thin slab consisting of a steel having 0.1-3% by weight of Mn and up to 0.01% by weight of B;

b) through-heating the slab or thin slab at a temperature (T1) of 1000-1400° C.;

c) pre-rolling the through-heated slab or thin slab to give an intermediate product having an intermediate product temperature (T2) of 1000-1200° C.;

d) hot rolling to give a hot-rolled flat steel product, where a final rolling temperature (T3) is 750-1000° C.;

e) winding the hot-rolled flat steel product, wherein a winding temperature (T4) is not more than 700° C.;

f) descaling the hot-rolled flat steel product;

g) cold rolling the flat steel product, wherein a degree of cold rolling is at least 30%;

h) annealing the flat steel product at an annealing temperature (T5) of 650-900° C.;

i) cooling the flat steel product to a dipping temperature (T6) of 650-800° C.;

j) coating the flat steel product that has been cooled to the dipping temperature with a coating having an applied layer weight of 15-30 g/m² by i. dipping it into a melt bath having a melting temperature (T7) of 670-710° C.;

ii. blowing the flat steel product dry after it has exited from the melt bath by means of a gas stream with a flow pressure of 200-750 mbar;

k) cooling the coated flat steel product to room temperature including cooling through a first cooling time $t_{mT}$ and a second cooling time $t_{nT}$, where the first cooling time $t_{mT}$ in a temperature range between 600° C. and 450° C. is more than 14 s, and the second cooling time $t_{nT}$ in a temperature range between 400° C. and 300° C. is more than 12 s;

l) skin pass rolling the coated flat steel product;

wherein the shaped sheet metal article comprises:

A) steel substrate consisting of a steel having 0.1-3% by weight of Mn and up to 0.01% by weight of B and B) an aluminium-based coating disposed on at least one side of the steel substrate, wherein the coating has an applied layer weight of 15-30 g/m² and consists of 1-15% by weight of Si, 15-35% by weight of Fe, 0.1-5% by weight of alkali metals or alkaline earth metals, and further constituents, the contents of which are limited to a total of not more than 2.0% by weight, and aluminium as the balance.

2. The shaped sheet metal article according to claim 1, wherein the coating has an Al base layer and an alloy layer, where the alloy layer lies atop the steel substrate and the Al base layer lies atop the alloy layer.

3. The shaped sheet metal article according to claim 2, wherein the Al base layer has a nano hardness of at least 1.3 GPa and the Al base layer has a penetration modulus of at least 79 GPa and the alloy layer has a nano hardness of at least 10.9 GPa and the alloy layer has a penetration modulus of at least 175 GPa and a near-surface region of the steel substrate has a nano hardness of at least 10.9 GPa and the near-surface region of the steel substrate has a penetration modulus of at least 205 GPa.

4. The shaped sheet metal article according to claim 3, wherein the steel substrate of the shaped sheet metal article has a microstructure having more than 90% martensite.

5. A shaped sheet metal article, comprising:

A) steel substrate consisting of a steel having 0.1-3% by weight of Mn and up to 0.01% by weight of B; and B) an aluminium-based coating disposed on at least one side of the steel substrate, wherein the coating has an applied layer weight of 15-30 g/m² and consists of 1-15% by weight of Si, 15-35% by weight of Fe, 0.1-5% by weight of alkali metals or alkaline earth metals, and further constituents, the contents of which are limited to a total of not more than 2.0% by weight, and aluminium as the balance.

6. The shaped sheet metal article according to claim 5, wherein the coating has an Al base layer and an alloy layer, where the alloy layer lies atop the steel substrate and the Al base layer lies atop the alloy layer.

7. The shaped sheet metal article according to claim 6, wherein the Al base layer has a nano hardness of at least 1.3 GPa and the Al base layer has a penetration modulus of at least 79 GPa and the alloy layer has a nano hardness of at least 10.9 GPa and the alloy layer has a penetration modulus of at least 175 GPa and a near-surface region of the steel substrate has a nano hardness of at least 10.9 GPa and the near-surface region of the steel substrate has a penetration modulus of at least 205 GPa.

8. The shaped sheet metal article according to claim 7, wherein the steel substrate of the shaped sheet metal article has a microstructure having more than 90% martensite.

* * * * *